US006665961B2

(12) United States Patent
Kobayashi et al.

(10) Patent No.: US 6,665,961 B2
(45) Date of Patent: Dec. 23, 2003

(54) GOLF SHOES

(75) Inventors: Kazuhiko Kobayashi, Kobe (JP); Toshihiro Horii, Kobe (JP); Seigou Sakagami, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/919,826

(22) Filed: Aug. 2, 2001

(65) Prior Publication Data

US 2002/0040539 A1 Apr. 11, 2002

(30) Foreign Application Priority Data

Aug. 3, 2000 (JP) ..... 2000-235175

(51) Int. Cl.[7] ..... A43B 5/00; A43B 15/00

(52) U.S. Cl. ..... 36/127; 36/59 C; 36/67 R; 36/67 A; D2/906; D2/954

(58) Field of Search ..... 36/127, 59 C, 36/67 R, 67 A, 59 R, 134, 129, 126, 25 R; D2/946, 906, 955, 954, 959, 960, 962

(56) References Cited

U.S. PATENT DOCUMENTS

D190,162 S * 4/1961 Hubbard ..... 36/59 C
3,006,085 A * 10/1961 Bingham, Jr. ..... 36/59 C
D266,287 S * 9/1982 Blissett et al. ..... D2/957
4,769,931 A * 9/1988 Morrow et al. ..... 36/134
5,926,974 A * 7/1999 Friton ..... 36/28
D414,594 S * 10/1999 Parisotto ..... D2/951
6,016,613 A * 1/2000 Campbell et al. ..... 36/127
D441,946 S * 5/2001 Agnew et al. ..... D2/953

FOREIGN PATENT DOCUMENTS

JP 02-295503 12/1990
JP 11-164703 6/1999

* cited by examiner

*Primary Examiner*—J. Mohandesi
(74) *Attorney, Agent, or Firm*—Birch, Stewart, Kolasch & Birch, LLP

(57) ABSTRACT

A shoe (L) for a left foot includes an outsole body (1). Both side slip prevention projections (3*a*) and (3*b*) and a non-both side slip prevention projection (5) are formed on a bottom surface of the outsole body (1). The outsole body (1), the both side slip prevention projections (3*a*) and (3*b*) and the non-both side slip prevention projection (5) are integrally formed of a composition containing rubber or synthetic resin as a principal component. Each of the both side slip prevention projections (3*a*) and (3*b*) has a bottom surface to be a grounding surface, a toe side slip prevention wall and a heel side slip prevention wall. The toe side slip prevention wall is formed along a convex line in a direction of a toe. The heel side slip prevention wall is formed along a convex line in a direction of a heel. A shoe (R) for a right foot has a shape obtained by transversely inverting the shape of the shoe (L) for the left foot.

3 Claims, 8 Drawing Sheets

GOLF SHOES

BACKGROUND OF THE INVENTION

1. Field of the Invention

The present invention relates to golf shoes, and more particularly to an improvement in a pattern of a bottom surface of golf shoes.

2. Description of the Related Art

When hitting a golf ball, a golf player sets an address such that a line connecting right and left tiptoes are in almost parallel with a hitting direction. In an address for a right-handed golf player, a left foot is positioned on the front side in the hitting direction and a right foot is positioned on the rear side in the hitting direction. In the address, a head of a golf club is positioned close to a golf ball. In this state, the golf player starts take-back, pulls the head rearward and then swings the golf club upward. The highest position of the head swung upward is equivalent to a top position. In the top position, a down swing is started and the head is swung downward so that the head impacts the golf ball. After the impact, the golf player swings the golf club forward and then upward (follow-through). Thus, a finish is attained.

From the top position to the finish, the golf player carries out a body turn by setting a left foot as a pivot. At the same time, the golf player kicks the ground by a right foot to transmit the force to the golf ball. In other words, a right-handed golf player uses a left foot as a pivoting foot and a right foot as a kicking foot. To the contrary, a left-handed golf player uses a right foot as the pivoting foot and a left foot as the kicking foot.

From the top position to the finish, great force is applied to both feet of the golf player. In some cases, the force causes golf shoes to slip off from the ground. In some cases in which the slip is caused, a swing form is disordered so that a misshot is generated.

In order to attain slip prevention, a needle-like spike pin formed of metal or ceramics is provided on the bottom surfaces of the golf shoes in some cases. In such golf shoes, the slip is considerably prevented. However, there is a problem in that the spike pin damages a lawn on a green, a floor in a clubhouse and a road surface of a passage for walking which is provided in a golf course. Moreover, the golf shoes having the spike pin give a push-up feeling and are not comfortable for the golf player to wear. In recent years, the golf shoes having the spike pin have not been preferred for use.

Golf shoes having a projection formed of rubber or synthetic resin which are provided on bottom surfaces in place of the spike pin have been proposed and spread. Such golf shoes rarely damage a lawn and are very comfortable to wear. In the golf shoes, however, there is a problem in that the projection has a smaller slip prevention performance than the spike pin. Japanese Patent No. 2946215 has proposed golf shoes in which a shoe for a left foot and a shoe for a right foot have different projection patterns in consideration of a difference in a role between the left and right feet. In respect of an enhancement in the slip prevention performance, however, the golf shoes still leave room for an improvement.

The present inventor investigated a vector of force applied to feet from the top position to the impact (that is, a magnitude and a direction) and found the following.

For a pivoting foot, force is roughly applied in almost a direction from a heel to a toe. In detail, the force is mainly applied to a rear portion in the hitting direction of the foot in the top position (toward an inside for the pivoting foot of the golf player) and the direction is also equivalent to a slightly rearward toe direction. Depending on the progress of a swing, the position to which the force is mainly applied is transferred to the center of the foot, and then a front portion (toward an outside for the pivoting foot of the golf player). Depending on the progress of the swing, moreover, the direction of the force is also transferred in a complete toe direction, and then in a slightly forward toe direction. It is supposed that these changes are caused by a body turn using a pivoting foot as a pivot and the movement of a weight.

For a kicking foot, force is roughly applied in almost a direction from the toe to the heel. In detail, the force is mainly applied to a front portion in the hitting direction of the foot in the top position (toward an inside for the kicking foot of the golf player) and the direction is also equivalent to a slightly forward heel direction. Depending on the progress of a swing, the position to which the force is mainly applied is transferred to the center of the foot, and then a rear portion (toward an outside for the kicking foot of the golf player). Depending on the progress of the swing, moreover, the direction of the force is also transferred in a complete heel direction, and then in a slightly rearward heel direction. It is supposed that these changes are caused by movement of a weight from the kicking foot to the pivoting foot at the time of the start of a downswing and the subsequent rotation of the kicking foot.

Based on these knowledges, the present inventor has proposed golf shoes in Japanese Patent Application No. 2000-123756 in which a pattern of a projection is varied in right and left shoes. In the golf shoes, a projection is formed along a convex line in a direction of a toe over a bottom surface of a shoe for a pivoting foot and a projection is formed along a convex line in a direction of a heel over a bottom surface of a shoe for a kicking foot. In a golf swing having such a very complicated movement pattern having a turning movement (body turn) and a translation movement, the golf shoes display an excellent slip prevention performance.

However, in the case in which the slip prevention is achieved by the projection having different patters on left and right, it is necessary to prepare both the golf shoes for a right-handed golf player and a left-handed golf player and the burden of a cost is increased for golf shoes manufactures. Moreover, if the left-handed golf player wears golf shoes for the right-handed golf player or the right-handed golf player wears golf shoes for the left handed golf player, there is a problem in that the slip prevention is insufficient during a swing. Furthermore, there is also a problem in that a shoe for a pivoting foot and a shoe for a kicking foot in the golf shoes easily slip on upward and downward slopes respectively.

The present invention has been made based on these knowledges and has an object to provide golf shoes for preventing a slip during a golf swing in the case in which any of the right-handed and left-handed golf players wears the golf shoes.

SUMMARY OF THE INVENTION

In order to achieve the above-mentioned object, the present invention provides golf shoes comprising an outsole body and a large number of projections formed of rubber or synthetic resin which are provided on a bottom surface of the outsole body, wherein both side slip prevention projections including a toe side slip prevention wall formed along a convex line in a direction of a toe and a heel side slip prevention wall formed along a convex line in a direction of a heel are mainly formed.

The golf shoes comprise the both side slip prevention projections. Also in the case in which any of the right-handed and left-handed golf players wears the golf shoes, a slip of a pivoting foot (a slip in almost a direction of a toe) and a slip of a kicking foot (a slip in almost a direction of a heel) can be prevented during a golf swing.

It is preferable that a ratio of the number of the both side slip prevention projections to the total number of the projections should be 50% or more. Consequently, it is possible to more prevent the slip during the golf swing.

It is preferable that an interior angle on a vertical section which is formed by the toe side slip prevention wall and the outsole body should be 60 degrees or more. Moreover, an interior angle on a vertical section which is formed by the heel side slip prevention wall and the outsole body is also 60 degrees or more. Consequently, it is possible to more prevent the slip during the golf swing.

DESCRIPTION OF THE PREFERRED EMBODIMENTS

The present invention will be described below in detail based on a preferred embodiment with reference to the drawings.

Figure 1:
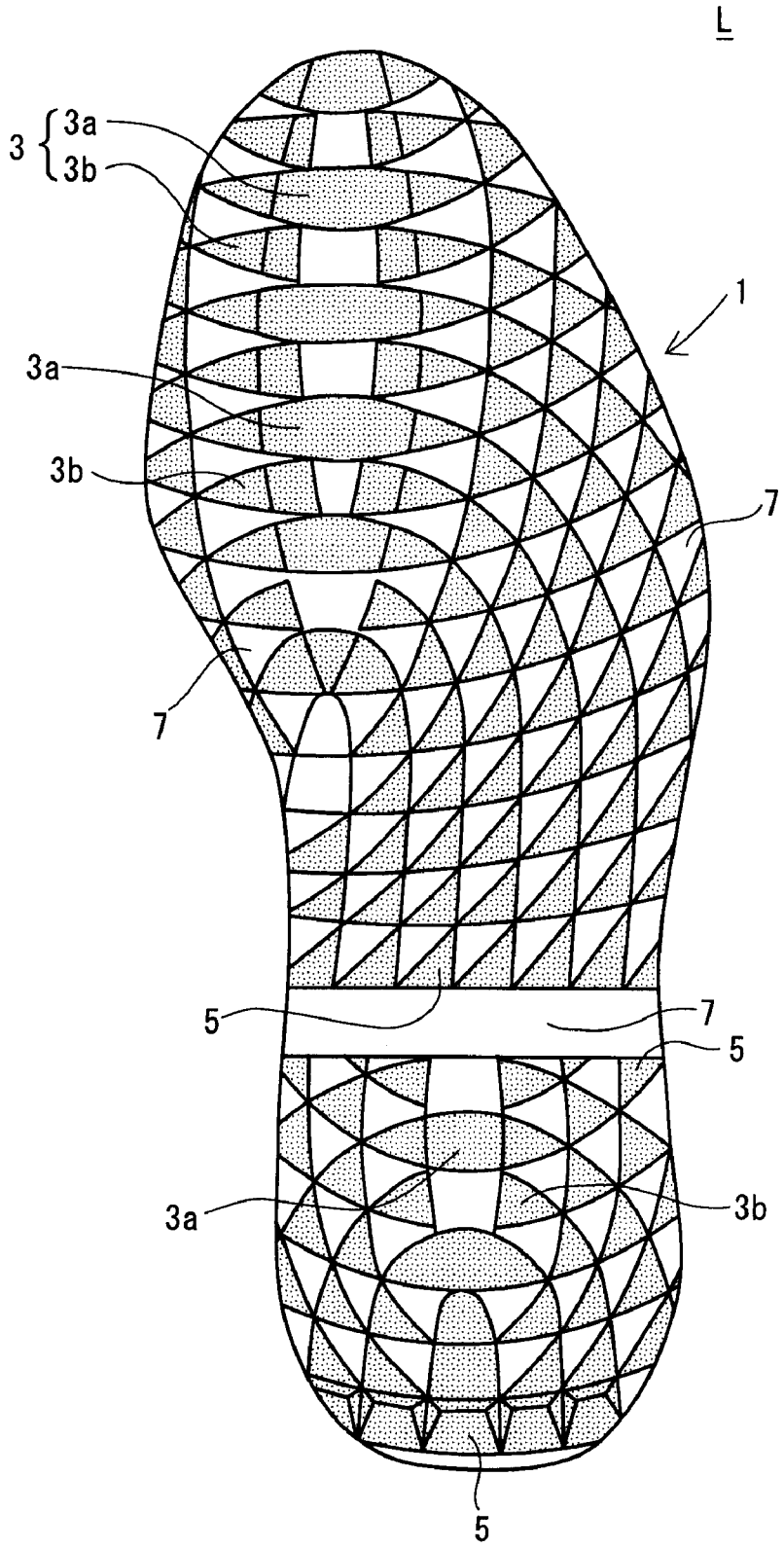
FIG. 1 is a bottom view showing a shoe L for a left foot of golf shoes according to an embodiment of the present invention.

FIG. 1 is a bottom view showing a shoe L for a left foot of golf shoes according to the embodiment of the present invention. The golf shoes comprise an insole and an upper portion in the same manner as in ordinary golf shoes, which is not shown. In FIG. 1, a right direction is set to be the front side in a hitting direction, a left direction is set to be the rear side in the hitting direction, an upward direction is set to be a direction of a toe, and a downward direction is set to be a direction of a heel.

The shoe L for the left foot includes an outsole body 1. A large number of projections 3 and 5 are formed on the bottom surface of the outsole body 1. The projections 3 and 5 are divided into a both side slip prevention projection 3 and a non-both side slip prevention projection 5. In FIG. 1, a portion shown in a dot indicates the projections 3 and 5. A portion of the bottom surface other than the projections 3 and 5 indicates a flat portion 7. The shoe outsole body 1 and the projections 3 and 5 are formed integrally. The outsole body 1 and the projections 3 and 5 are formed of a composition containing rubber or synthetic resin as a principal component.

Figure 2:
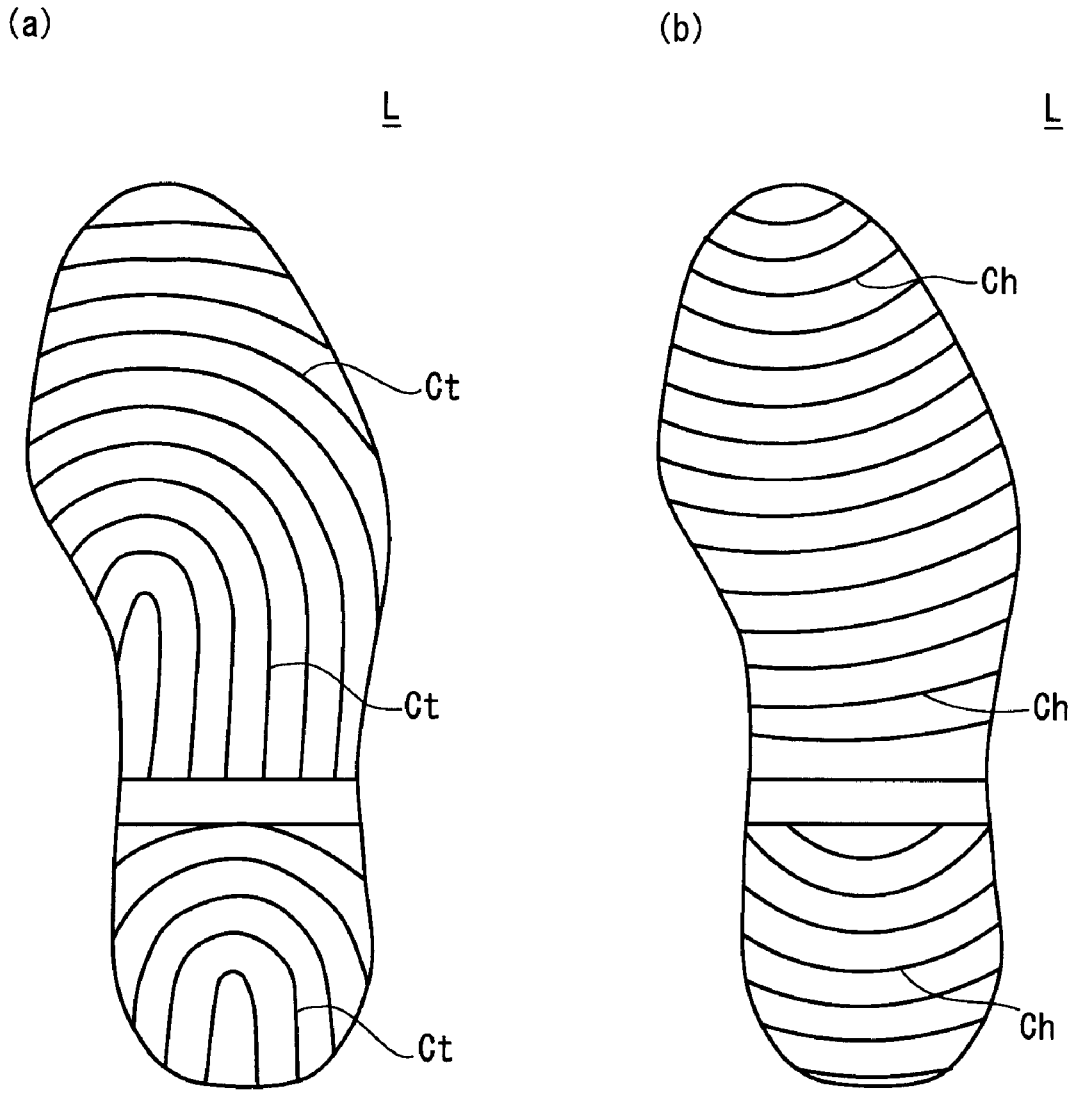
FIG. 2 is a typical view showing a line Ct which is convex in a direction of a toe and a line Ch which is convex in a direction of a heel in the shoe L for the left foot illustrated in FIG. 1.

The both side slip prevention projection 3 is formed along a convex line in a direction of a toe and a convex line in a direction of a heel. FIG. 2(*a*) is a typical view showing a line Ct which is convex in the direction of the toe in the shoe L for the left foot in FIG. 1. Moreover, FIG. 2(*b*) is a typical view showing a line Ch which is convex in the direction of the heel in the shoe L for the left foot in FIG. 1. The line Ct to be convex in the direction of the toe represents a line going from one end to the direction of the toe, passing through a portion which is the closest to the toe, going to the direction of the heel and ending at the other end. Moreover, the line Ch to be convex in the direction of the heel represents a line going from one end to the direction of the heel, passing through a portion which is the closest to the heel, going to the direction of the toe and ending at the other end. The line Ct to be convex in the direction of the toe and the line Ch to be convex in the direction of the heel maybe circular arcs or parabolas. Moreover, a curve having an inflection point in the middle such as a sine curve may be used. Furthermore, a combination of a plurality of segments or a combination of a segment and a curve may be used.

It is preferable that the line Ct to be convex in the direction of the toe and the line Ch to be convex in the direction of the heel should be designed by the following method. First of all, a golf player is caused to carry out a golf swing and floor reaction force in each of horizontal and vertical directions during the swing is measured by a three-dimensional floor reaction force meter to calculate a ratio of a horizontal load to a vertical load. Next, a peak point at which the ratio has a maximum value is determined. Then, a start point at which the ratio has 60% of the maximum value in a stage of a rise toward the maximum value and an end point at which the ratio has 60% of the maximum value in a stage of a fall from the maximum value are determined. Subsequently, horizontal component vectors of three-dimensional floor reaction force data at a predetermined interval between the start point and the end point are arranged with origins thereof coincident with each other. Next, a reference line to connect the front ends of the vectors is assumed. A reference line for a pivoting foot is obtained by the measurement of floor reaction force in the pivoting foot and a reference line for a kicking foot is obtained by the measurement of floor reaction force in the kicking foot. The reference line for the pivoting foot which is subjected to variable power at a predetermined ratio is set to be the line Ct which is convex in the direction of the toe. Moreover, the reference line for a kicking foot which is subjected to variable power at a predetermined ratio is set to be the line Ch which is convex in the direction of the heel. Such a floor reaction force measuring method has been disclosed in Japanese Laid-Open Patent Publication No. 2000-219431.

Figure 3:
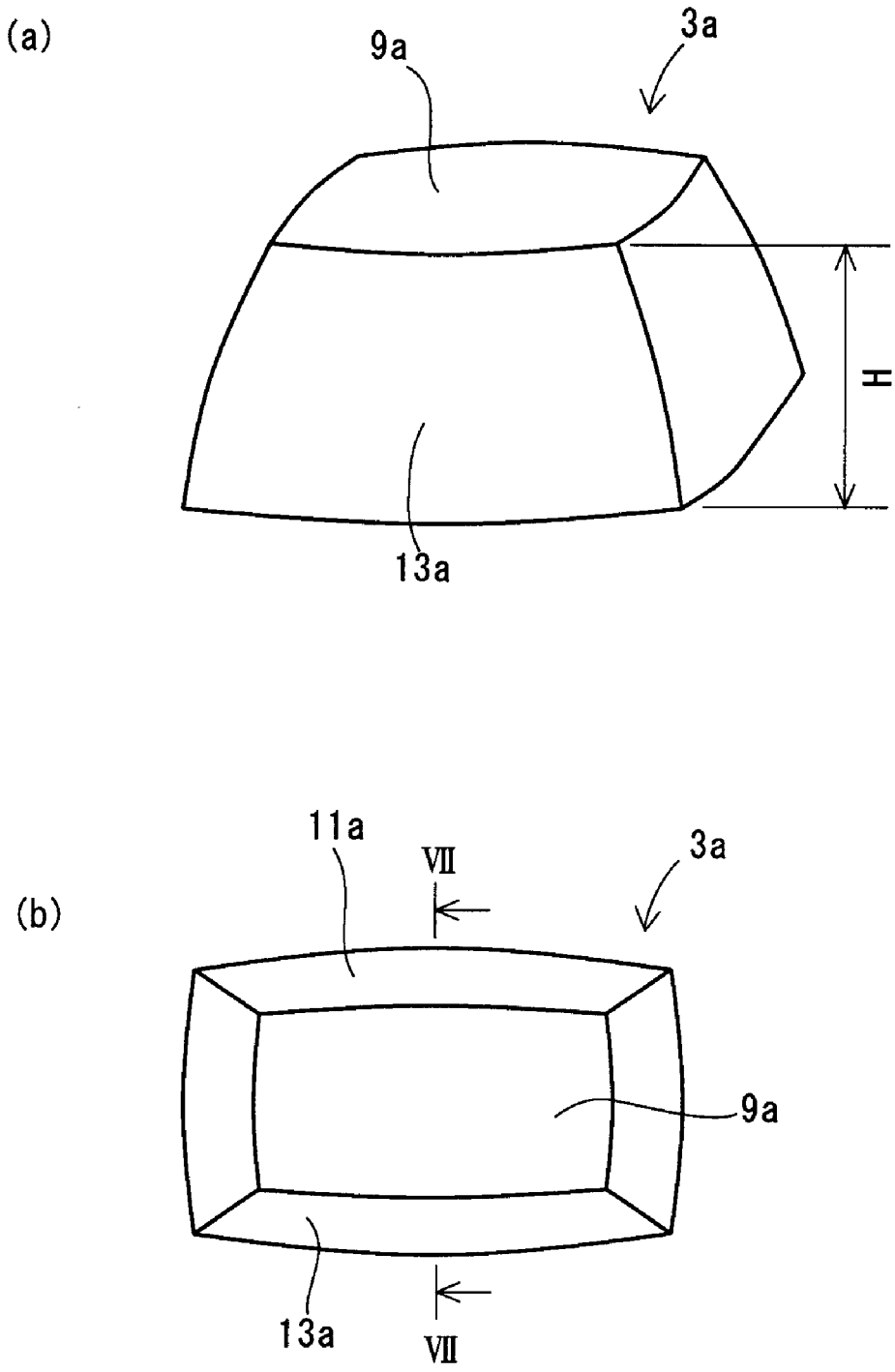
FIG. 3 is an enlarged view showing an example of both side slip prevention projections of the shoe L for the left foot illustrated in FIG. 1.

FIG. 3(*a*) is an enlarged perspective view showing an example of a both side slip prevention projection 3*a* of the shoe L for the left foot in FIG. 1 and FIG. 3(*b*) is a bottom view thereof (which is obtained by seeing FIG. 3(*a*) from above). In FIG. 3(*b*), an upward direction is set to be the direction of the toe and a downward direction is set to be the direction of the heel. The both side slip prevention projection 3*a* includes a bottom surface 9*a* to be a grounding surface and four side walls having a toe side slip prevention wall 11*a* and a heel side slip prevention wall 13*a*. The toe side slip prevention wall 11*a* is formed along the Ct (FIG. 2(*a*)) to be convex in the direction of the toe. The heel side slip prevention wall 13*a* is formed along the line Ch (see FIG. 2 (*b*)) to be convex in the direction of the heel.

Figure 4:
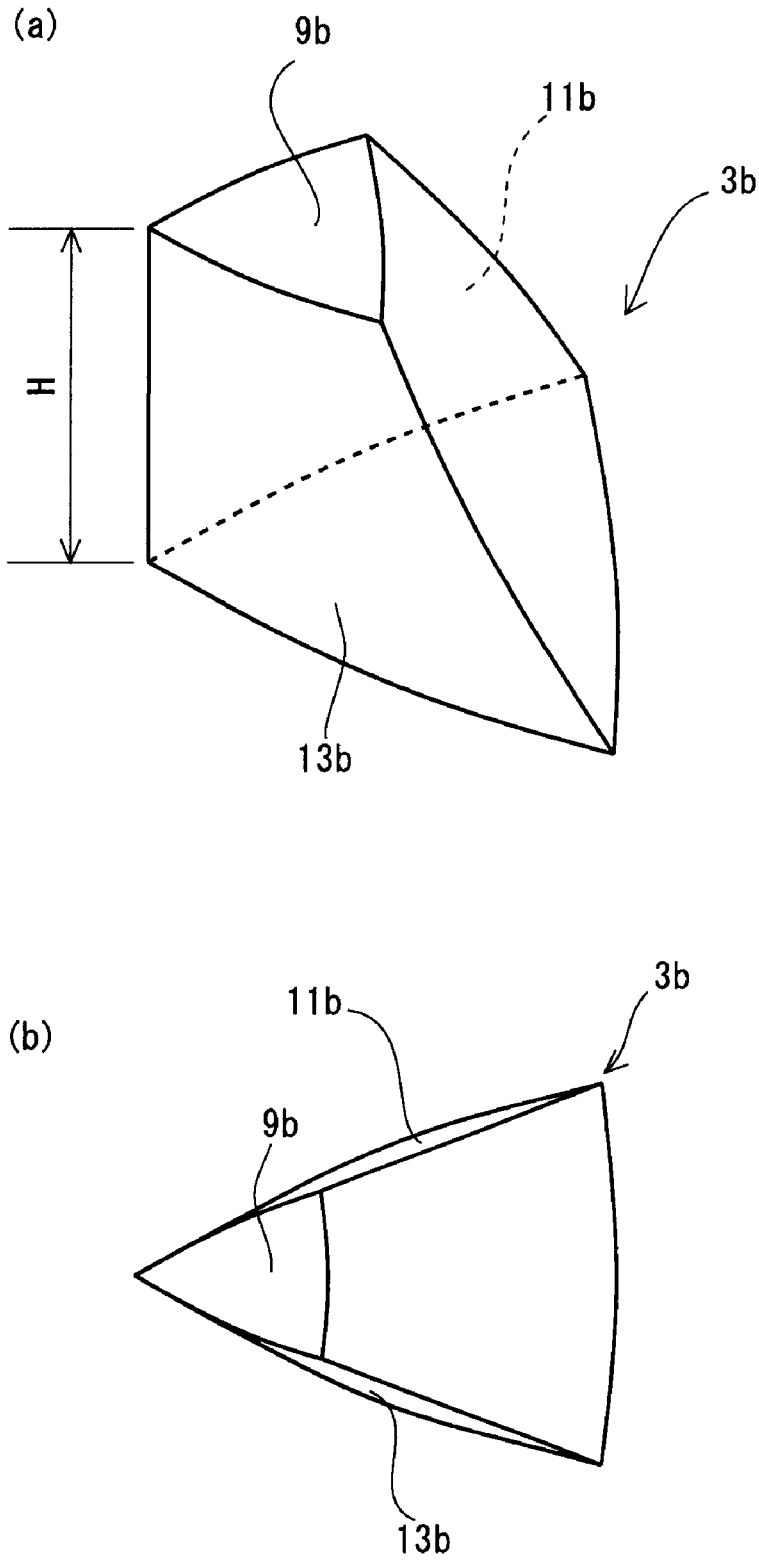
FIG. 4 is an enlarged view showing other both side slip prevention projections of the shoe L for the left foot illustrated in FIG. 1.

FIG. 4 (*a*) is an enlarged perspective view showing another both side slip prevention projection 3*b* in the shoe L for the left foot in FIG. 1 and FIG. 4 (*b*) is a bottom view thereof (which is obtained by seeing FIG. 4(*a*) from above). In FIG. 4(*b*), an upward direction is set to be the direction of the toe and a downward direction is set to be the direction of the heel. The both side slip prevention projection 3*b* includes a bottom surface 9*b* to be a grounding surface and three side walls having a toe side slip prevention wall 11*b* and a heel side slip prevention wall 13*b*. The toe side slip prevention wall 11*b* is formed along the line Ct (see FIG. 2(*a*)) to be convex in the direction of the toe. The heel side slip prevention wall 13*b* is formed along the line Ch (see FIG. 2(*b*)) to be convex in the direction of the heel.

Figure 5:
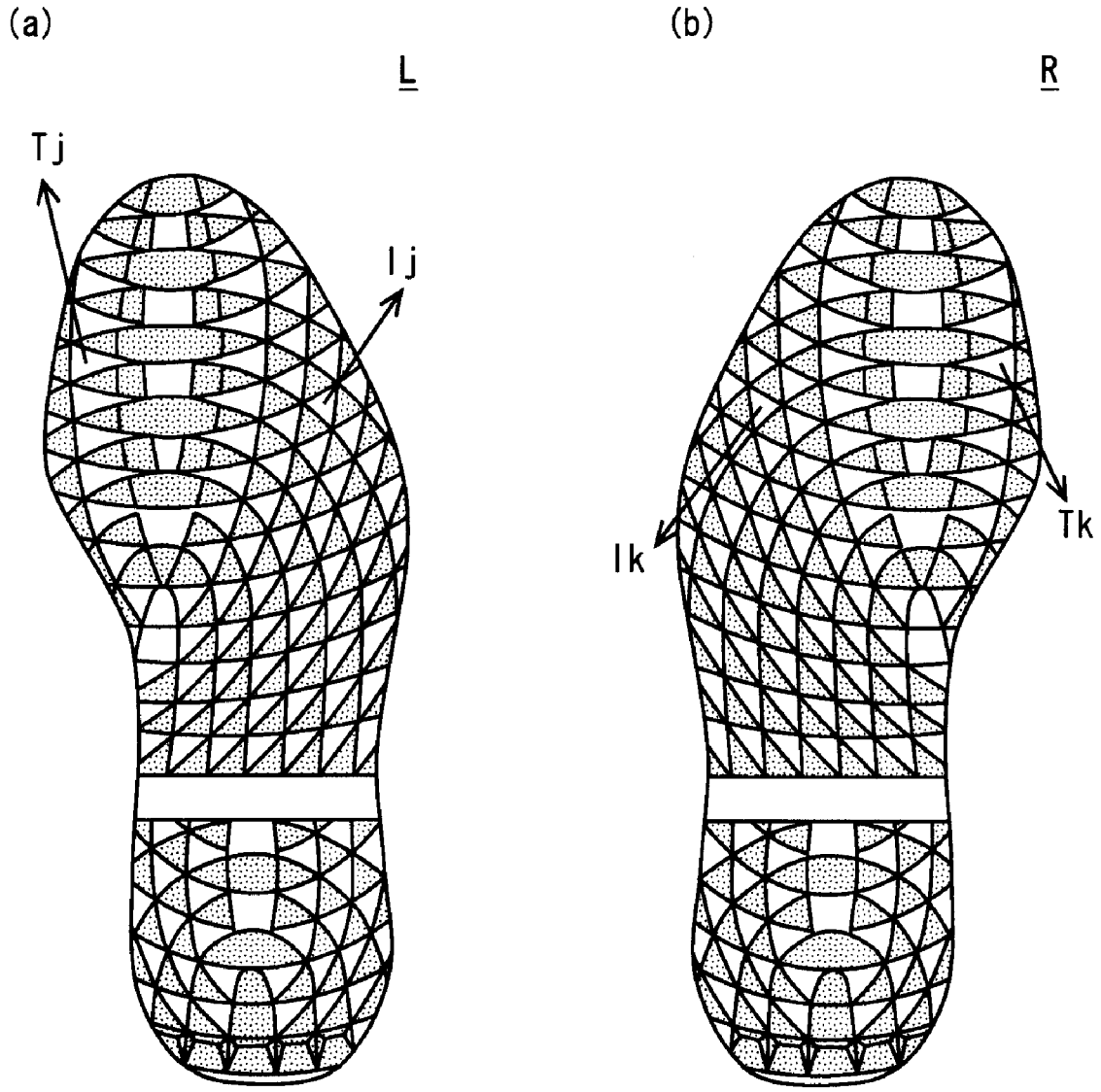
FIG. 5 is a bottom view showing an example of a vector of force applied to the golf shoes illustrated in FIG. 1.

FIG. 5 is a bottom view showing the golf shoes illustrated from FIG. 1 to FIG. 4 together with a vector of force applied to a foot in the case in which a right-handed golf player wears the golf shoes. FIG. 5(*a*) is a bottom view showing the shoe L for the left foot in FIG. 1 and FIG. 5(*b*) is a bottom view showing a shoe R for the right foot in the golf shoes. The shoe R for the right foot has a shape obtained by transversely inverting the shape of the shoe L for the left foot. The left foot (pivoting foot) wears the shoe L and the right foot (kicking foot) wears the shoe R.

In FIG. 5(*a*), a narrow Tj indicates a vector of force applied to the shoe L for the left foot in a top position. Moreover, an arrow Ij indicates a vector of force applied to the shoe L for the left foot immediately before an impact. During a swing from the top position to a point immediately before the impact, the position and direction of the force applied to the shoe L for the left foot are momentarily changed in an almost clockwise direction in the drawing from a state shown in the arrow Tj to a state shown in the arrow Ij.

As described above, the toe side slip prevention walls 11*a* and 11*b* of the both side slip prevention projections 3*a* and 3*b* are formed along the line Ct to be convex in the direction of the toe. During the vector of the force is transferred from the state shown in the arrow Tj to the state shown in the arrow Ij, therefore, any portion of the toe side slip prevention walls 11*a* and 11*b* is almost orthogonal to a direction of the vector. Consequently, the shoe L for the left foot can be effectively prevented from slipping in almost the direction of the toe.

In FIG. 5(*b*), an arrow Tk indicates a vector of force applied to the shoe R for the right foot in the top position. Moreover, an arrow Ik indicates a vector of force applied to the shoe R for the right foot immediately before the impact. During the swing from the top position to the point immediately before the impact, the position and direction of the force applied to the shoe R for the right foot are momentarily changed in an almost clock wise direction in the drawing, generally, from a state shown in the arrow Tk to a state shown in the arrow Ik.

As described above, the heel side slip prevention walls 13*a* and 13*b* of the both side slip prevention projections 3*a* and 3*b* are formed along the line Ch to be convex in the direction of the heel. During the vector of the force is transferred from the state shown in the arrow Tk to the state shown in the arrow Ik, therefore, any portion of the heel side slip prevention walls 13*a* and 13*b* is almost orthogonal to the direction of the vector. Consequently, the shoe R for the right foot can be effectively prevented from slipping in almost the direction of the heel.

Figure 6:
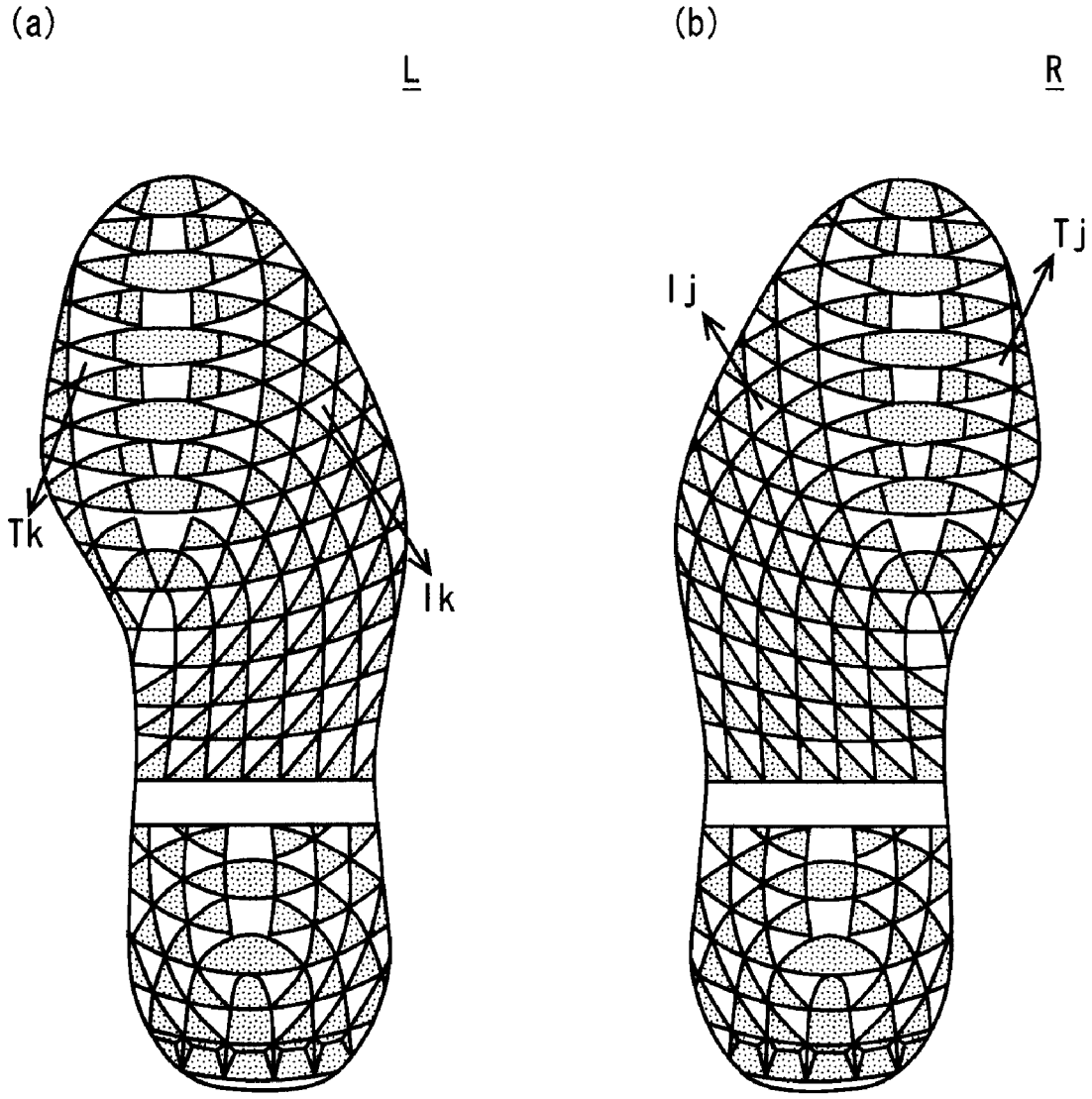
FIG. 6 is a bottom view showing another example of the vector of the force applied to the golf shoes illustrated in FIG. 1.

FIG. 6 is a bottom view showing the golf shoes in FIG. 5 together with a vector of force applied to the foot when a left-handed golf player wears the golf shoes. The left foot (kicking foot) wears the shoe L and the right foot (pivoting foot) wears the shoe R.

In FIG. 6(*a*), a narrow Tk indicates a vector of force applied to the shoe L for the left foot in the top position. Moreover, an arrow Ik indicates a vector of force applied to the shoe L for the left foot immediately before the impact. During the swing from the top position to the point immediately before the impact, the position and direction of the force applied to the shoe L for the left foot are momentarily changed in an almost clockwise direction in the drawing, generally, from a state shown in the arrow Tk to a state shown in the arrow Ik.

As described above, the heel side slip prevention walls 13*a* and 13*b* of the both side slip prevention projections 3*a* and 3*b* are formed along the line Ch to be convex in the direction of the heel. During the vector of the force is transferred from the state shown in the arrow Tk to the state shown in the arrow Ik, therefore, any portion of the heel side slip prevention walls 13*a* and 13*b* is almost orthogonal to the direction of the vector. Consequently, the shoe L for the left foot can be effectively prevented from slipping in almost the direction of the heel.

In FIG. 6(*b*), a narrow Tj indicates a vector of force applied to the shoe R for the right foot in the top position. Moreover, an arrow Ij indicates a vector of force applied to the shoe R for the right foot immediately before the impact. During the swing from the top position to the point immediately before the impact, the position and direction of the force applied to the shoe R for the right foot are momentarily changed in an almost clockwise direction in the drawing from a state shown in the arrow Tj to a state shown in the arrow Ij.

As described above, the toe side slip prevention walls 11*a* and 11*b* of the both side slip prevention projections 3*a* and 3*b* are formed along the line Ct to be convex in the direction of the toe. During the vector of the force is transferred from the state shown in the arrow Tj to the state shown in the arrow Ij, therefore, any portion of the toe side slip prevention walls 11*a* and 11*b* is almost orthogonal to the direction of the vector. Consequently, the shoe R for the right foot can be effectively prevented from slipping in almost the direction of the toe.

Thus, the toe side slip prevention walls 11*a* and 11*b* mainly display the slip prevention performance if a right-handed golf player wears the shoe L, and the heel side slip prevention walls 13*a* and 13*b* mainly display the slip prevention performance if a left-handed golf player wears the shoe L. On other hand, the heel side slip prevention walls 13*a* and 13*b* mainly display the slip prevention performance if the right-handed golf player wears the shoe R for the right foot, and the toe side slip prevention walls 11*a* and 11*b* mainly display the slip prevention performance if the left-handed golf player wears the shoe R. Also in the case in which any of the right-handed and left-handed golf players wears the golf shoes, the both side slip prevention projections 3*a* and 3*b* can prevent the golf shoes from slipping during a swing. The golf shoes are suitable for both the right-handed golf player and the left-handed golf player. In addition, the toe side slip prevention walls 11*a* and 11*b* of the golf shoes can prevent the shoe L and the shoe R from slipping on a downward slope, and the heel side slip prevention walls 13*a* and 13*b* of the golf shoes can prevent the shoe L and the shoe R from slipping on an upward slope.

Figure 7:
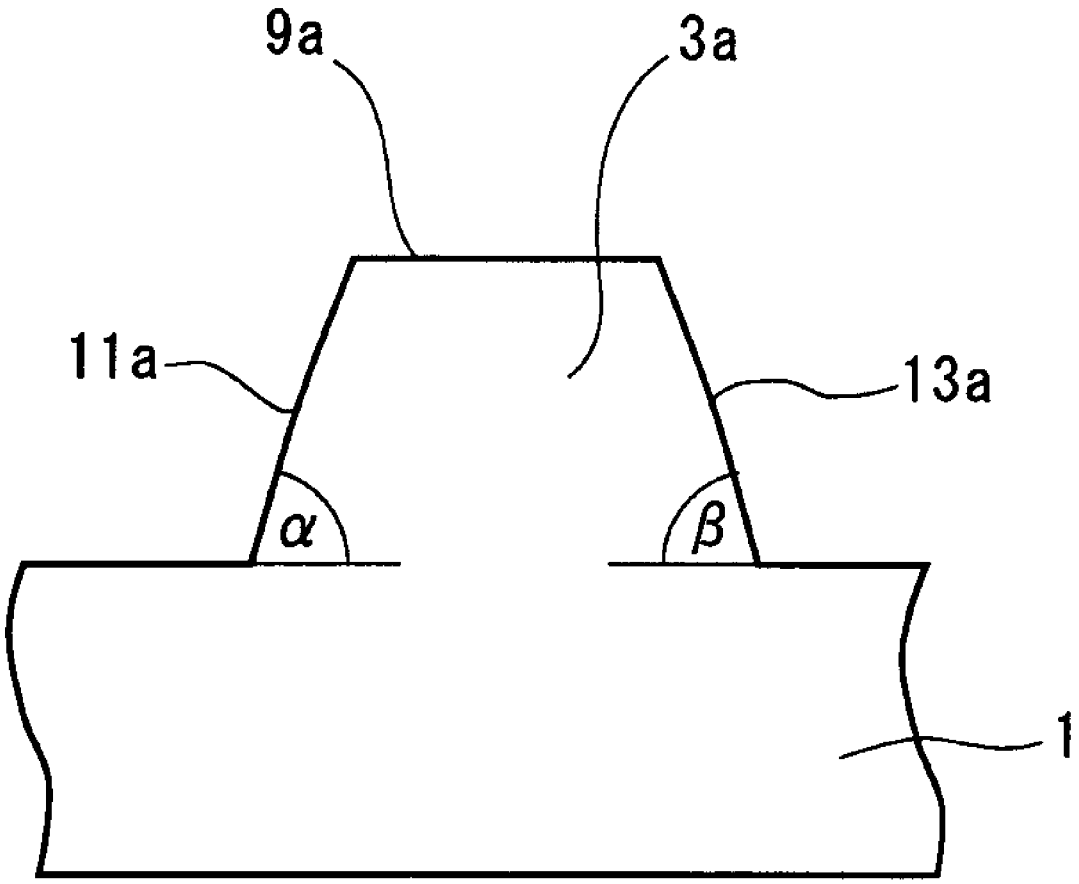
FIG. 7 is a sectional view taken along the line VII—VII in FIG. 3.

FIG. 7 is a sectional view (vertical sectional view) taken along the line VII—VII in FIG. 3(*b*). In FIG. 7, the outsole body 1 is shown together with the both side slip prevention projection 3*a*. In FIG. 7, α indicates an interior angle formed by the toe side slip prevention wall 11*a* and the outsole body 1. Moreover, β indicates an interior angle formed by the heel side slip prevention wall 13*a* and the outsole body 1. The interior angles α and β are preferably 60 degrees or more, and more preferably 80 degrees or more. If the interior angles α and β are less than the above-mentioned range, the slip prevention performance of the shoe L and the shoe R becomes insufficient in some cases. It is preferable that the interior angles α and β should be 120 degrees or less. If the interior angles α and β are more than 120 degrees, it is hard to remove the outsole body 1 from a mold during molding. In the both side slip prevention projection 3*b* shown in FIG. 4, an interior angle on a vertical section formed by each of the toe side slip prevention wall 11*b* and the heel side slip prevention wall 13*b* and the outsole body 1 is preferably 60 to 120 degrees, and more preferably 80 to 120 degrees.

In each of the shoe L for the left foot and the shoe R for the right foot, a ratio of the number of the both side slip prevention projections 3 to the total number of the projections 3 and 5 is preferably 50% or more, more preferably 70% or more, and most preferably 85% or more. Ideally, the ratio is 100%. Consequently, it is possible to more prevent the shoe L for the left foot and the shoe R for the right foot from slipping.

A height of the both side slip prevention projection 3 (shown in an arrow H in FIGS. 3(*a*) and 4(*a*)) is preferably 2 mm to 25 mm, and more preferably 5 mm to 15 mm. If the height H is less than the above-mentioned range, the slip prevention performance becomes insufficient in some cases. If the height H is more than the above-mentioned range, the projection is easily bent.

While only the both side slip prevention projection 3 and the non-both side slip prevention projection 5 are protruded from the bottom surface of the outsole body 1, a pin formed of synthetic resin or the like is further provided supplementarily. In particular, when the pin is provided in the vicinity of a portion corresponding to the root of the thumb (that is, a portion to which a high foot pressure is applied), the shoe L for the left foot and the shoe R for the right foot can be more prevented from slipping.

It is preferable that a ratio (grounding area ratio) of the total grounding area of the projections 3 and 5 to the bottom surface area of the outsole body 1 in the shoe L for the left foot and the shoe R for the right foot should be 20% to 80%. If the grounding area ratio is less than the above-mentioned range, the slip prevention property on a hard road surface through which the projections 3 and 5 do not stick becomes insufficient in some cases. From this viewpoint, it is particularly preferable that the grounding area ratio should be 30% or more. If the grounding area ratio is more than the above-mentioned range, a grounding pressure becomes insufficient in some cases. From this viewpoint, it is particularly preferable that the grounding area ratio should be 70% or less. The bottom surface area of the outsole body 1 implies the area obtained on the assumption that the bottom surface is flat (that is, the projections 3 and 5 are not formed). Moreover, the total grounding area of the projections 3 and 5 implies the total of all grounding area of the projections 3 and 5 formed in the shoe L and the shoe R, respectively.

It is preferable that the numbers of the projections 3 and 5 in the shoe L for the left foot and the shoe R for the right foot should be 10 to 1000, respectively. If the numbers of the projections 3 and 5 are less than the above-mentioned range, a region having a large area in which the projections 3 and 5 are not present at all is generated. For example, in the case in which the same region is positioned just below a sesamoid, the slip prevention performance becomes insufficient during walking in some cases. From this viewpoint, it is particularly preferable that the numbers of the projections 3 and 5 should be 20 or more. If the numbers of the projections 3 and 5 are more than the above-mentioned range, the sizes of the individual projections 3 and 5 are reduced so that the rigidity of each of the projections 3 and 5 becomes insufficient in some cases. From this viewpoint, it is particularly preferable that the numbers of the projections 3 and 5 should be 100 or less.

As described above, also in the case in which any of the right-handed and left-handed golf players wears the golf shoes according to the present invention, an excellent slip prevention performance can be displayed in a golf swing to be a very complicated movement pattern having a mixture of a turning movement (body turn) and a translational movement. The golf player wears the golf shoes so that a slip can be prevented during a swing. Consequently, it is possible to prevent a misshot from being caused by the disorder of a swing form.

EXAMPLE

Rubber composition containing butadiene rubber as a principal component was put in a mold and was heated and crosslinked to form a shoe outsole having an outsole body and both side slip prevention projections. An upper portion, an insole and the like were attached to the shoe outsole to obtain golf shoes according to an example. The shape and arrangement of the projection of the golf shoes are shown in FIGS. 1 to 7.

COMPARATIVE EXAMPLE

Figure 8:
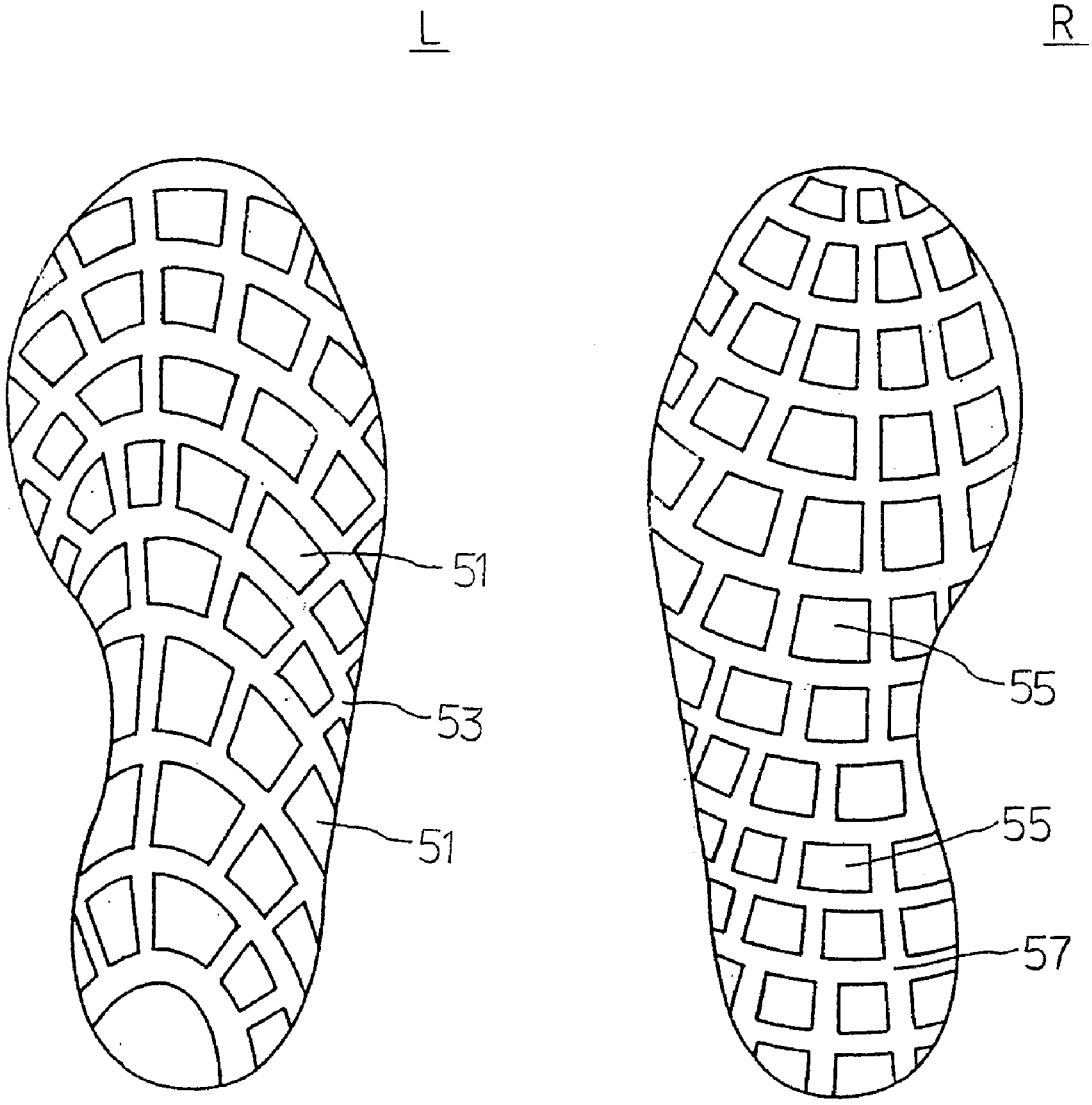
FIG. 8 is a bottom view showing golf shoes according to a comparative example of the present invention.

Golf shoes according to a comparative example were obtained in the same manner as those in the example except that a mold is changed and the pattern of an outsole is varied. The shape and arrangement of the projection of the golf shoes are shown in FIG. 8. A shoe L for a left foot of the golf shoes has a projection 51 and a flat portion 53, and the projection 51 is formed along a convex line in a direction of a toe. Moreover, a shoe R for a right foot has a projection 55 and a flat portion 57, and the projection 55 is formed along a convex line in a direction of a heel.

Evaluation of Slip Prevention Performance

A right-handed golf player and a left-handed golf player wore golf shoes and hit a golf ball with a driver on a teeing ground of a golf course. Moreover, the golf players walk on a downward slope having a lawn surface. Thus, a slip prevention performance was functionally evaluated in five stages of "1" to "5". The most difficulty to slip was set to "5" and the most easiness to slip was set to "1". The result is shown in the following Table 1.

TABLE 1

Result of Evaluation of Slip Prevention Performance

| | Example | Comparative Example |
|---|---|---|
| Slip prevention performance during swing | | |
| Right-handed golf player | 5 | 5 |
| Left-handed golf player | 5 | 3 |
| Slip prevention performance On downward slope | | |
| Shoe for left foot | 5 | 5 |
| Shoe for right foot | 5 | 3 |

In the Table 1, it is apparent that the golf shoes according to the comparative example slip with difficulty in the swing of the right-handed golf player and easily slips in the swing of the left-handed golf player. On the other hand, the golf shoes according to the example slip with difficulty during the swing for both the right-handed golf player and the left-handed golf player. Moreover, the shoe for the right foot in the golf shoes according to the comparative example easily slips on the downward slope, while both the shoes for the right and left feet in the golf shoes according to the example slip with difficulty. From the evaluation, the advantage of the present invention is apparent.

The above description is only illustrative and various changes can be made without departing from the scope of the present invention.

What is claimed is:

1. Golf shoes comprising an outsole body including individual projections extending from the outsole body formed of rubber or synthetic resin on a bottom surface of the outsole body on both a heel portion of said outsole body and a toe portion of said outsole body, at least a portion of said projections on said heel portion and said toe portion comprising both side slip prevention projections which each include a toe side slip prevention wall formed along forwardly-facing portion of said both side slip prevention projection and a heel side slip prevention wall formed along a rearwardly-facing portion of said projection, said toe side slip prevention walls of adjacent both side slip prevention projections defining a line which is convex in the direction of a toe, and said heel side slip prevention walls of said adjacent both side slip prevention projections defining a line which is convex in the direction of a heel, and wherein the toe side slip prevention walls which define said line which is convex in the direction of said toe are coextensive with said line, and wherein the heel side slip prevention walls which define said line which is convex in the direction of said heel are coextensive with said line.

2. The golf shoes according to claim 1, wherein the ratio of the number of said both side slip prevention projections to the total number of the projections on said outsole is 50% or more.

3. The golf shoes according to claim 1, wherein an interior angle on a vertical section which is formed by the toe side slip prevention wall and the outsole body is 60 degrees or more and an interior angle on a vertical section which is formed by the heel side slip prevention wall and the outsole body is 60 degrees or more.

* * * * *